United States Patent [19]

Cardus

[11] 4,312,091

[45] Jan. 26, 1982

[54] APPARATUS FOR APPLYING A PASTY OR LIKE PRODUCT BY MEANS OF A ROTARY COATING PAD

[76] Inventor: Francis Cardus, Domaine Anjoun, Saint-Gilles-les-Bains, Ile de la Réunion, France

[21] Appl. No.: 102,947

[22] Filed: Dec. 12, 1979

[30] Foreign Application Priority Data

Jan. 4, 1979 [FR] France ..... 79 00142

[51] Int. Cl.[3] ..... A47L 23/06

[52] U.S. Cl. ..... 15/97 A; 15/29; 401/140

[58] Field of Search ..... 15/29, 24, 97 R, 97 A, 15/50 R; 401/129, 130, 139, 140, 171, 176, 179, 188, 196, 194, 199, 263

[56] References Cited

U.S. PATENT DOCUMENTS

| | | | |
|---|---|---|---|
| 2,137,944 | 11/1938 | MacLeod | 401/140 |
| 2,728,928 | 1/1956 | Beeren | 15/29 |
| 3,921,858 | 11/1975 | Bemm | 401/171 X |
| 4,016,617 | 4/1977 | Cardus | 15/29 |
| 4,078,865 | 3/1978 | Moser | 401/140 X |
| 4,089,609 | 5/1978 | Gring et al. | 401/130 |

FOREIGN PATENT DOCUMENTS

| | | | |
|---|---|---|---|
| 1503906 | 7/1969 | Fed. Rep. of Germany | 15/29 |
| 79938 | 1/1963 | France | 15/29 |
| 2196778 | 3/1974 | France . | |
| 2382882 | 11/1978 | France | 15/97 R |

*Primary Examiner*—Edward M. Coven
*Attorney, Agent, or Firm*—Michael J. Striker

[57] ABSTRACT

This apparatus for applying a pasty or similar product by means of a rotary coating pad carried by a cartridge comprises a motor for driving this cartridge through gears. The cartridge encloses a piston adapted to slide freely in the cartridge bore and pneumatic or other means, preferably a pump, are incorporated in the apparatus case for exerting a pressure against the inner end of the piston and thus force the product out through the coating pad. This pad has a two-portion structure so that the cartridge can easily be filled or refilled through this pad, the apparatus being particularly but not exclusively suited for applying boot-polish or like products.

6 Claims, 5 Drawing Figures

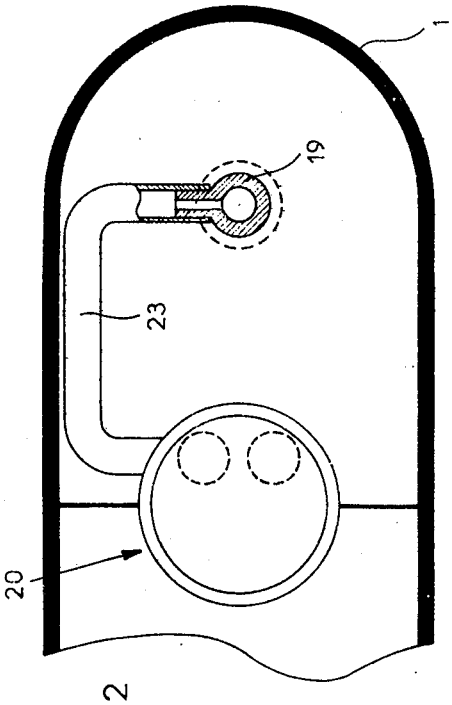
FIG_2
FIG_3
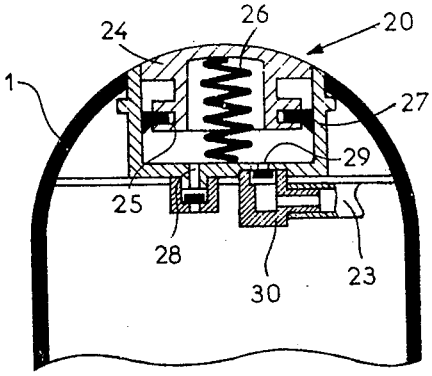
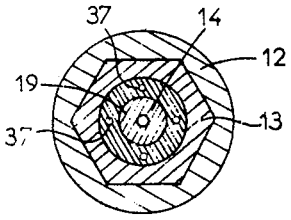
FIG_4
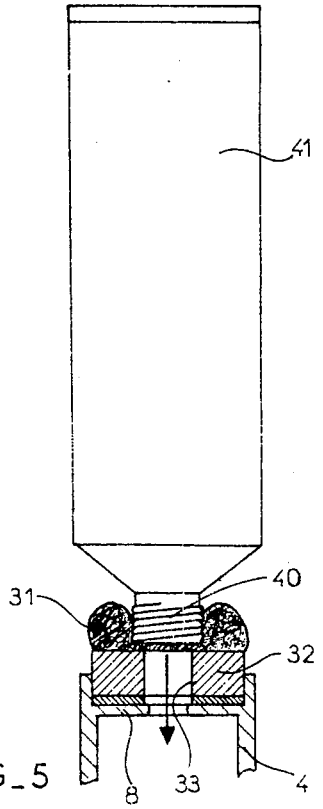
FIG_5

APPARATUS FOR APPLYING A PASTY OR LIKE PRODUCT BY MEANS OF A ROTARY COATING PAD

BACKGROUND OF THE INVENTION

1. Field of the Invention

The present invention relates to a portable apparatus for use as an applicator or dispenser of a pasty or similar product by means of a rotary coating pad, this product consisting for example a boot-polish or other similar shoe-shining or treatment products.

2. Description of the Prior Art

In the U.S. Pat. No. 4,016,617 the applicant already disclosed and illustrated a portable apparatus intended for the same use. In this known apparatus the coating pad is carried by a cartridge filled with the treatment product and rotatably driven by an electric motor housed within the case of the apparatus.

The product is forced outwardly by a spring-loaded piston so that it impregnates the porous applicator pad and flows through this pad when the latter is caused to contact a surface to be treated.

However, the presence of a piston constantly urged by a spring located within the cartridge is a source of difficulties when it is desired to refill the cartridge when the latter is empty. In fact, in this case the cartridge must have a filling hole provided with a non-return or safety valve to prevent the subsequent outflow of the cartridge current.

But in this case, it is not possible to fill the cartridge unless the product is driven into it with a force sufficient to open the valve and at the same time cause the piston to recede against the force of its spring. Under these conditions, this refilling operation is difficult to achieve, inasmuch as the product is usually kept in a tube of deformable material to which it is hardly possible to apply a relatively strong pressure.

SUMMARY OF THE INVENTION

It is therefore the essential object of this invention to provide an improved apparatus of the type broadly set forth hereinabove which is so designed that the cartridge incorporated therein can be filled very easily.

To this end, the applicator apparatus according to the instant invention for pasty or like products such as boot-polish is characterised in that the cartridge has slidably and freely mounted therein a piston, and that pneumatic or other similar delivery means capable of operating against the back end of the piston for pressurizing the product contained in the cartridge are provided so that when said delivery means are actuated the product will tend to flow through the coating pad, the structure of this coating pad being such that the cartridge can be filled by a simply forcing the product to flow inwardly through the porous pad.

Thus, the empty cartridge can be filled very easily through the coating pad proper. For this purpose, the outlet orifice of the deformable tube containing the desired product is applied on the active surface of the pad and even a relatively moderate or light pressure exerted on this tube is sufficient for causing the product contained therein to flow through the pad. In fact, this flow can take place freely since the means incorporated in the apparatus for delivering the product under pressure can be neutralized during the refilling operation.

Besides, to facilitate this refilling operation the rotary pad of the coating cartridge comprises preferably two separate portions, namely an outer portion of flexible open-cell foam-like material and a rigid or semi-rigid inner portion comprising an axial bore having a diameter smaller than that of the conventional delivery orifices of the tubes containing maintenance products such as boot-polish.

In a preferred and advantageous form of embodiment of the apparatus of this invention, the rotary cartridge is detachably mounted in the apparatus and the delivery means incorporated in the apparatus are so arranged that they cannot exert any pressure on the cartridge piston unless the latter is properly positioned in the apparatus.

Preferably, the delivery means associated with the back end of the piston comprise an air delivery pump driven by means of a manually-operated push-button projecting from the outer surface of the case, this push-button being associated with a piston slidably fitted in a small socket provided with a delivery orifice coupled to an outlet passage leading to the bottom of the rotary cartridge when the latter is fitted home into the apparatus.

However, other features and advantages of the invention will appear as the following description proceeds with reference to the accompanying drawing illustrating diagrammatically a typical form of embodiment of the apparatus of this invention, given by way of example, not of limitation. In the drawing:

BRIEF DESCRIPTION OF THE DRAWING

FIG. 2 is a fragmentary section taken along the line II—II of FIG. 1;

FIGS. 3 and 4 are fragmentary sections taken along the lines III—III and IV—IV of FIG. 1, respectively; and FIG. 5 is a fragmentary section showing the outer end of the coating cartridge taken during a cartridge filling or refilling operation.

DESCRIPTION OF THE PREFERRED EMBODIMENT

Figure 1:
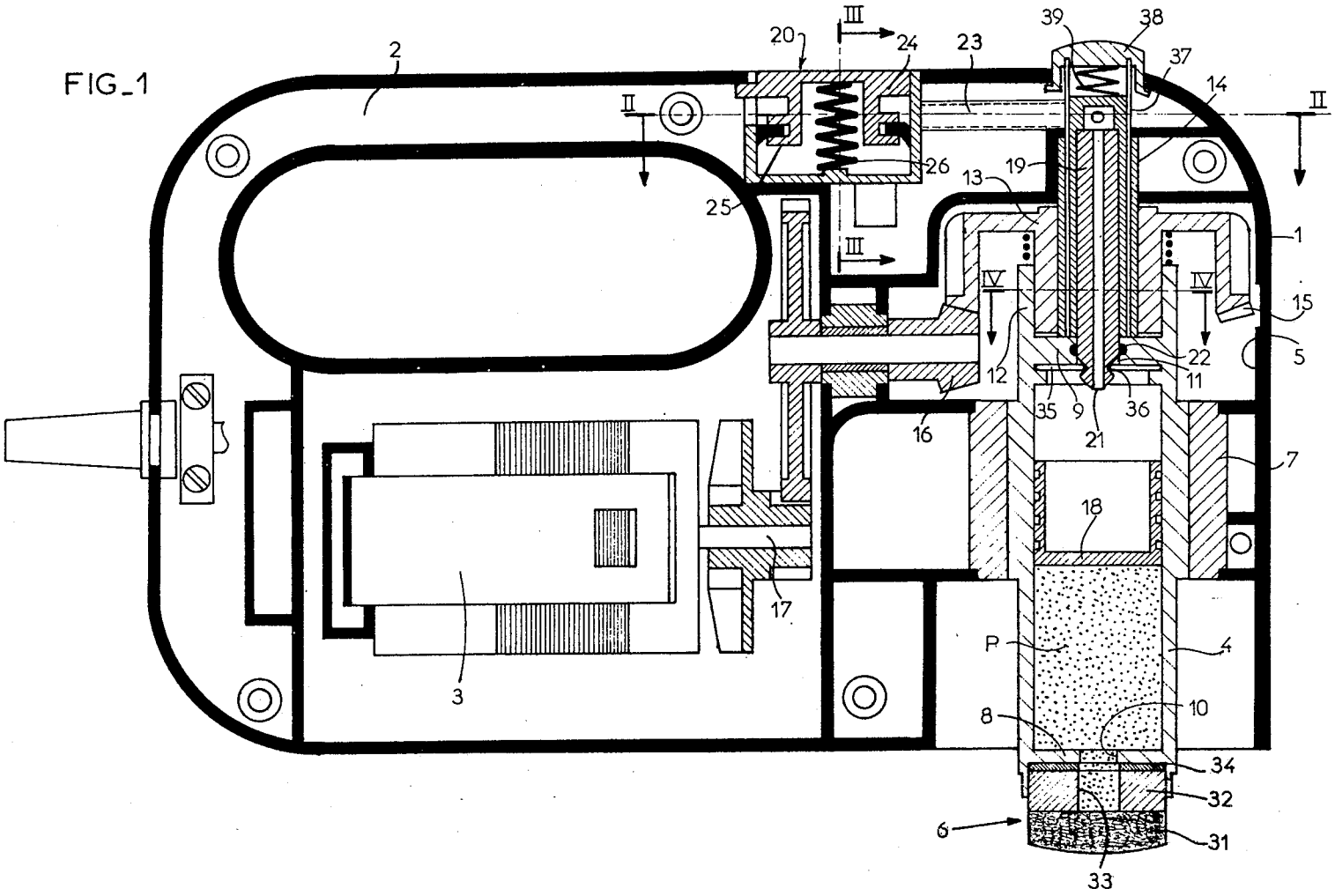
FIG. 1 is a diagrammatical longitudinal section showing the apparatus of this invention.

The apparatus illustrated in the drawing comprises a case 1 of flexible material, which advantageously comprises a grip handle-forming portion 2. Underlying this grip handle 2 is a compartment enclosing an electric motor 3 for rotatably driving the detachable cartridge 4 filled with the product to be used. This cartridge is located within another compartment 5 of the apparatus case. However, the lower or outer end of cartridge 4 protrudes from the case 1 and carries a coating pad designated in general by the reference numeral 6, a cap (not shown) being provided for covering this pad when the apparatus is not in use. The pad structure, to be described in detail presently, is such that the cartridge can be filled or refilled by simply causing the product to be forced through the pad.

The cartridge 4 has a generally cylindrical configuration and is rotatably mounted in a fixed sleeve 7. This cartridge is closed at either ends by partitions 8 and 9, respectively, one partition 8 supporting the coating pad 6 and the other constituting the cartridge bottom. Both partitions 8, 9 are formed with a central hole 10 or an axial passage 11 for a purpose to be described presently.

Beyond its bottom 9, the cartridge 4 comprises a skirt fitting around a driving socket 13. The rotary coupling of these two members is obtained forming the socket with a female polygonal inner end engaged by a corresponding central projecting male portion of said skirt 12 (see FIG. 4). Thus, it is only necessary to fit the rear or inner end of cartridge 4 into the driving socket 13 for rotatably coupling these two members.

The driving socket 13 is rotatably mounted on a fixed cylinder 14 and rotatably driven via a circular set of bevel teeth 15 formed integrally on the socket and in constant meashing engagement with a corresponding bevel pinion 16 operatively connected via other gear means to the output shaft 17 of the electric motor 3.

According to an essential feature characterising this apparatus, the coating cartridge 4 contains a piston 18 mounted for free axial movement therein. However, this piston 18 can be pressed with a certain force against the product P contained in the cartridge. For this purpose, the bottom of compartment 5 receiving the cartridge 4 comprises a fixed air delivery tube 19 connected to a manual pump 20 to be described presently.

This tube 19 extends coaxially within the cylinder 14. However, its inner end 21 projects from the cylinder bottom and engages the central passage 11 of the inner wall or bottom 9 of cartridge 4. In this respect, it may be pointed out that this passage 11 comprises a seal 22 fitted into a corresponding groove formed in its wall for imparting the necessary fluid-tightness thereto. Thus, the tube 19 opens into the rear or inner portion of cartridge 4, i.e. into the chamber formed therein between the free piston 18 and the bottom of said cartridge.

A pipe 23 connects the other or outer end of tube 19 to the delivery pump 20. This manually-operated pump 20 comprises a pump body 27 and is adapted to be actuated by means of a push member 24 slidably fitted in the upper portion of case 1. This push member 24 comprises a piston-forming portion 25 and is responsive to an antagonistic spring 26. Two ports or orifices 28 and 29 formed through the bottom of the pump body 27 are associated with valve members operating in opposite directions, respectively, so that these valve members control the one the air inlet port and the other the air delivery port. The delivery port 29 is connected via said coupling pipe 23 to the delivery tube 19.

As clearly apparent in FIG. 1, the coating pad 6 comprises two separate portions, namely an outer portion 31 of open-cell foam-like material and an inner portion 32 of semi-rigid or rigid material consisting for example of a closed-cell material. However, this second portion comprises an axial bore 33 of a diameter smaller than the conventional diameter of the outlet orifice of the tubes usually provided for containing pasty treatment products such as boot-polish or the like. These two portions 31 and 32 are associated with a rigid washer 34 and the assembly is secured to the corresponding end wall 8 of cartridge 4.

As already explained in the foregoing, the cartridge is detachably mounted into the compartment 6 of the apparatus and held in position by simple elastic snap-in means.

To this end, the cartridge comprises ahead of its bottom wall 9 a pair of parallel hairpin- or like spring wires 35 adapted snappily to engage a groove 36 formed on the projecting end 21 of the fixed tube 19.

However, means are provided for very easily ejecting the cartridge 4 from the apparatus case; these means consist of four rods 37 of relatively small diameter which are slidably mounted in corresponding holes formed in the fixed cylinder 14 parallel to the axis thereof, said rods 37 being carried by a control knob 38 responsive to a return spring 39. Now the opposed ends of these rods 37 register with the bottom 9 of cartridge 4, so that the latter can be ejected by simply depressing the knob 38.

The primary advantageous feature of the apparatus of the present invention lies in the ease with which the cartridge 4 can be filled or refilled. In fact, this operation can be accomplished by simply pressing the neck 40 of a tube 41 containing the treatment product to be dispensed against the coating pad 6, of course after having removed the cartridge 4 from the apparatus. Due to the pressure exerted through the neck 40 against the flexible outer portion of the coating pad, the latter forms an annular bead surrounding said neck as illustrated in FIG. 5 and acting as a seal to prevent any undesired leakage of the product during the transfer thereof from the tube 41 to the cartridge 4.

This transfer is accomplished very easily by causing the product contained in tube 41 to flow through the central area of the flexible outer portion of pad 6 and exerting only a moderate pressure on the tube 41. In fact, this transfer takes place easily since the piston 18 is freely movable in the bore of cartridge 4, and can thus move backwards to the bottom of the cartridge in order to free more space for the product, inasmuch as during this filling operation the pneumatic delivery means incorporated in the apparatus are inoperative since the cartridge is filled after removing it from the apparatus.

However, it may be pointed out that during this filling operation the neck 40 of tube 41 bears against the edges of the central aperture 33 of the inner portion 32 of the coating pad. This will avoid any risk of collapsing or damaging the pad. Moreover, the inner portion 32 of this pad will channel the product towards the inner space of the cartridge.

When the filling operation is completed, the apparatus can be restored to its operating condition by simply re-introducing the cartridge into the sleeve 7 of compartment 5. In fact, this single movement is sufficient for simultaneously:

coupling the cartridge 4 with the driving socket 13 for rotation therewith connecting the cartridge bottom to the pressurizing pump by causing the end 21 of tube 19 to penetrate into the axial passage 11 of the cartridge bottom, and holding the cartridge in position due to the snap engagement of the spring wires 35 into the groove 36 formed in the end of tube 19.

When it is desired to pressurize the product contained in cartridge 4, it is only necessary to actuate the delivery pump 20 by depressing several times the push-button 24 thereof. Thus, a pressure will develop in the bottom chamber of cartridge 4, so that the piston 18 will force out the product P contained therein.

Of course, the detachable cartridge 4 may be replaced by another, similar cartridge containing a different product. Thus, in case the present apparatus were used for applying boot-polish or a similar product to shoes, a plurality of interchangeable detachable cartridges 4 containing boot-polish of different colors may be provided.

In this respect, it may also be noted that it is another object of this invention to provide cartridges of the type set forth hereinabove which may be marketed independently of the apparatus itself. These cartridges are characterised in that they comprise on the one hand a piston fitted for free axial movement therein and on the other hand a porous pad through which a pasty product can be forced for filling the cartridge.

Preferably, this pad has the specific structure depicted hereinabove, which is advantageous in that the corresponding cartridge can be filled therethrough. However, this specific structure is also advantageous in that, when the cartridge is used with the apparatus the passage 33 formed through the inner portion 32 of the pad will channel the corresponding product towards the outer portion 31, in which the product is distributed. In fact, the inner portion 32 of the pad is fluid-tight and will thus avoid any risk of lateral leakage of the product.

The manually-operated pump contemplated in the apparatus of this invention may be replaced if desired by other delivery means, whether of the pneumatic or otherwise actuated type, adapted to exert a pressure against the bottom of the free piston incorporated in a detachable cartridge provided with a pad of the above-described type, when this cartridge is fitted in the apparatus. Thus, it is possible to contemplate resilient delivery means capable of actuating this piston when the cartridge is fitted in the apparatus. However, it is also possible to provide other delivery means the actuation of which is controlled by the user of the apparatus.

It may also be pointed out that the coating pad of the cartridge is secured preferably detachably to the cartridge so that it can easily be replaced in case of wear or damage.

Besides, the apparatus of this invention may also comprise, in addition to the coating cartridge, a polishing brush. In this case, the brush is of the rotary type and surrounds the coating pad location. Moreover, the arrangement is preferably similar to the one contemplated in the French Pat. No. 75 00265 already mentioned in the preamble of this specification, so that the user can use in succession the coating pad of the rotary cartridge and then the annular polishing brush.

What is claimed is:

1. An apparatus for applying a pasty or liquid product by means of a coating member comprising a housing; a detachable cartridge carrying the coating member and filled with a product to be applied, said cartridge being mounted in said housing for a rotary movement, and having one end portion connected to the coating member and another end portion; a motor located in said housing; transmission means operatively interconnecting said motor with said cartridge and including reduction gears cooperating with said motor and a toothed bevel gear operatively connected to said reduction gears; spring means including spring wires mounted on said another end portion and adapted to resiliently retain said cartridge in said housing, said cartridge being formed with a bore; a piston mounted in said bore for slidable reciprocating movement and operative for controllably pushing the product to be applied towards the coating member; a manually-operated pump accommodated in said housing and operative for supplying pressurized air to said piston; a tubular member fixedly mounted in said housing and adapted for delivering the pressurized air from said pump to said bore; a socket rigidly and concentrically mounted on said tubular member and provided with said bevel gear, said cartridge having a non-circular recess formed at said other end portion thereof, said socket having a projection matching with said non-circular recess and engageable thereby, said tubular member being provided with an external groove, said spring wires surrounding said groove for resiliently retaining said cartridge on said tubular member in a snapped-in engagement, said coating member including an upper portion associated with said cartridge and formed of a relatively rigid material, and a lower portion formed of a relatively soft closed-cell foam-like material, said piston dividing said bore into a first chamber for receiving the pressurized air from said tubular member and a second chamber filled with the product to be applied, said second chamber being associated with the coating member whereby said piston under pressure of the pressurized air urges the product to be applied out from said second chamber; and a seal in said cartridge for preventing any leakage of air pressurized by said pump from said first chamber.

2. The apparatus as claimed in claim 1, wherein said one end portion of said cartridge is formed with a recess into which said upper portion of said coating member is fitted, said one end portion having an end wall and being provided with a collar forming with said end wall said recess and surrounding at least partially said upper portion.

3. The apparatus as claimed in claim 2, wherein said end wall and said upper portion are formed with central orifices communicating with one another and associating with said second chamber of said cartridge, and wherein a washer is provided between said end wall and said upper portion, said washer having a central opening communicating with said orifices, whereby when desired said second chamber may be filled with said product from a dispensing tube by pressing a dispensing neck of said tube against said lower portion of said coating member so that the relatively soft material thereof will form a sealing bead around said neck and thus prevent any lateral leakage of said product during the cartridge filling operation accomplished by pressing said tube.

4. The apparatus as claimed in claim 3, wherein said non-circular recess of said cartridge and said projection of said socket have a polygonal configuration.

5. The apparatus as claimed in claim 4, including a spring interposed between said socket and said non-circular recess of said cartridge.

6. The apparatus as claimed in claim 5, further including means for ejecting said cartridge from said housing, said ejecting means including a plurality of push-rods of relatively small diameter surrounding said tubular member and disposed on a common circumference concentric to said tubular member, and an external push-button mounted on said housing and communicating with said push-rods, said socket being formed with a number of bores receiving said push-rods for slidable movement therein, said push-rods being adapted to be driven inwardly by means of said external button whereby said cartridge can be ejected by depressing said push-button and thus causing said push-rods to exert a pressure against said cartridge to disengage said spring wires from said groove of said tubular member.

* * * * *